United States Patent [19]

Anderson, Jr. et al.

[11] Patent Number: 4,961,398

[45] Date of Patent: Oct. 9, 1990

[54] DAVIT ASSEMBLY

[75] Inventors: Robert C. Anderson, Jr., Gloversville; Robert O. Perry, Jr., Tribes Hill, both of N.Y.

[73] Assignee: Mountain Marine, Inc., New York, N.Y.

[21] Appl. No.: 309,661

[22] Filed: Feb. 13, 1989

[51] Int. Cl.[5] ..... B63B 23/06

[52] U.S. Cl. ..... 114/368; 114/373

[58] Field of Search ..... 114/365, 368, 369, 373, 114/44

[56] References Cited

U.S. PATENT DOCUMENTS

| | | | |
|---|---|---|---|
| 522,787 | 7/1894 | Ench et al. . | |
| 755,241 | 3/1904 | Powers . | |
| 1,040,822 | 10/1912 | Waterworth | 114/373 |
| 1,043,625 | 11/1912 | Petrie . | |
| 1,364,727 | 1/1921 | Dawson . | |
| 1,424,227 | 8/1922 | Wright . | |
| 1,896,845 | 2/1933 | Hyland | 114/373 |
| 2,073,566 | 3/1937 | Scheubner . | |
| 2,173,421 | 9/1939 | Krzeminsky | 114/370 |
| 2,294,864 | 9/1942 | Palmer | 114/368 |
| 2,473,557 | 6/1949 | Woodruff | 114/373 |
| 3,086,227 | 4/1963 | Schat | 114/370 |
| 3,747,137 | 7/1973 | Simpson | 114/368 |
| 3,834,338 | 9/1974 | Renouf | 114/373 |
| 4,139,110 | 2/1979 | Roberts | 114/372 |
| 4,526,126 | 7/1985 | Dunn | 114/365 |

*Primary Examiner*—Sherman Basinger

*Attorney, Agent, or Firm*—Nixon & Vanderhye

[57] ABSTRACT

A davit assembly for use in supporting a vessel in either of two alternative positions, comprising a generally upright frame and a vessel support arm pivotally attached to the frame for movement between a first position where a first portion of the support arm is adapted to support a vessel in a substantially horizontal orientation, and a second position where a second portion of the support arm is adapted to support the vessel in a substantially vertical orientation.

24 Claims, 5 Drawing Sheets

FIG. 1
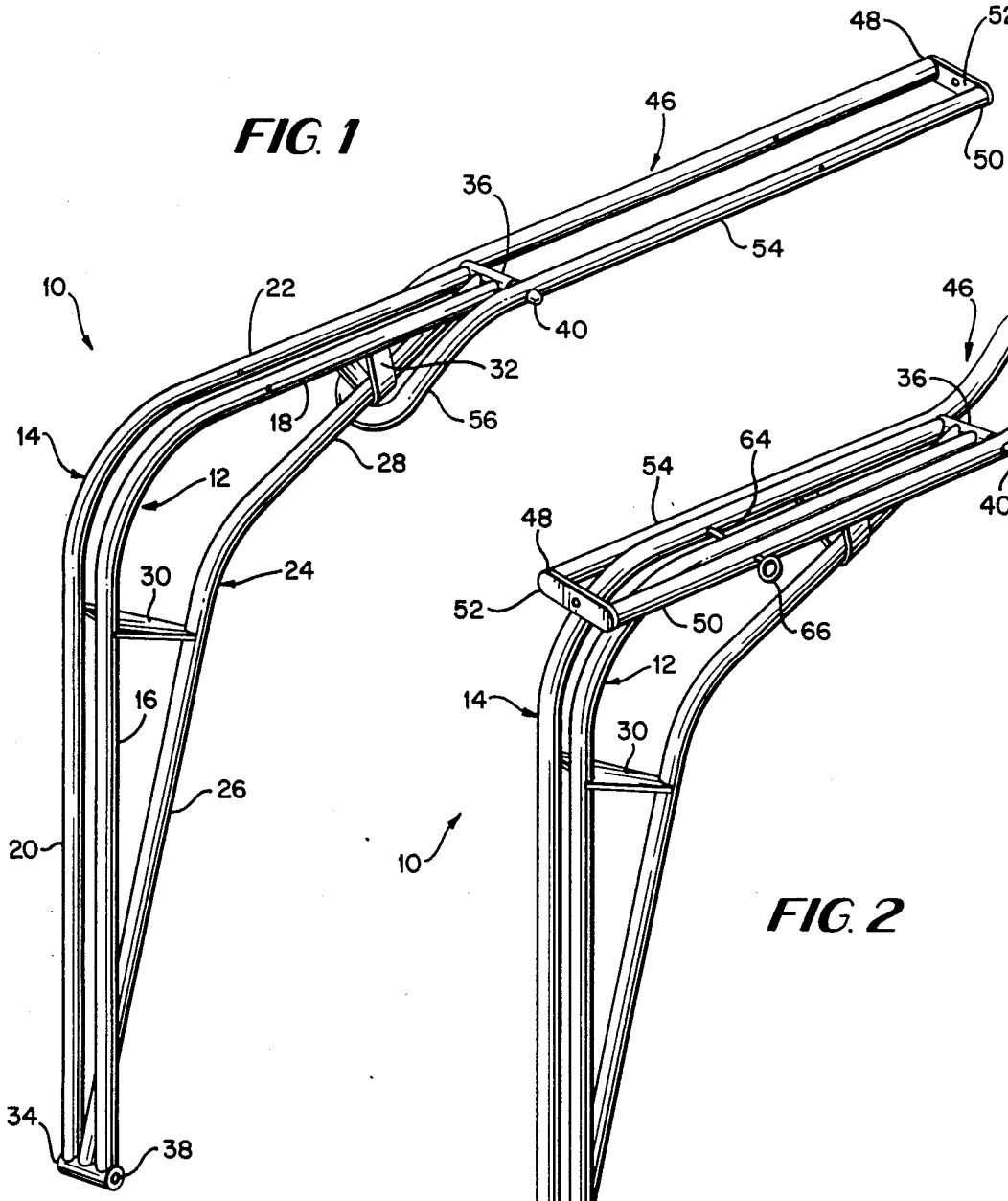
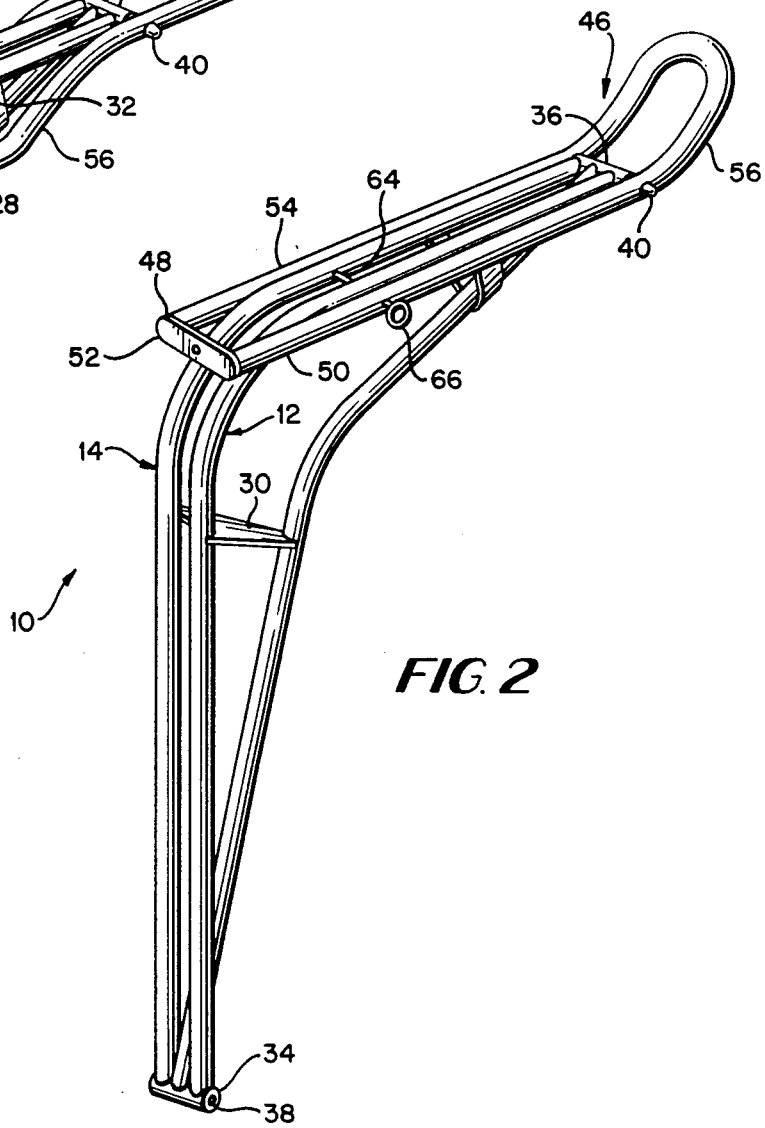
FIG. 2

DAVIT ASSEMBLY

BACKGROUND AND SUMMARY OF THE INVENTION

The present invention relates to davit assemblies for supporting dinghies, row boats, rafts or the like on the deck or other surface of a larger vessel. More specifically, the present invention relates to a davit assembly which is designed to support a vessel, and particularly an inflatable raft, in either of two alternative positions.

There are, of course, many known davit constructions for supporting smaller vessels on the decks or other supporting surfaces of larger vessels. Typically, the smaller vessel is supported in a horizontal or upright orientation such that the bottom of the smaller vessel is substantially parallel to the water surface or to the deck surface of the larger vessel. In some instances, the davits are capable of supporting the smaller vessel in a storage as well as a deployment position, but in such cases, the upright orientation of the smaller vessel itself does not change, but only its lateral position with respect to the larger vessel, i.e., inboard or outboard, and perhaps its vertical position relative to the boat deck as well. See, for example, U.S. Pat. Nos. 552,787; 1,040,822; 1,364,727; 2,173,421; and 3,086,227.

There are also known davit assemblies which permit a boat or dinghy to be moved between horizontal deployment and vertical storage positions. In such assemblies, however, the boat or dinghy is attached to the davit in its horizontal or use position and the supporting arm and boat are then rotated about 90° to a storage position. See, for example, U.S. Pat. Nos. 294,864 and 3,834,338.

The present invention relates to a simple, manually operable davit assembly. Use of two such assemblies, spaced apart in a conventional manner, permits a vessel, preferably of the inflatable raft-type, to be supported in either of two positions. In the first position, the vessel is supported horizontally such that a bottom surface of the vessel is oriented substantially parallel to the water surface, or boat deck. In the second position, the vessel is supported vertically on its side, so that the bottom surface thereof extends substantially perpendicular to the water surface or deck.

In one exemplary embodiment, the davit assembly of this invention includes an upright frame, generally in the shape of an inverted "L" so that a substantially horizontal portion extends away from an upper end of a substantially vertical portion. The frame may also include one or more reinforcing members to provide additional support and rigidity. The frame is also intended to be secured to a larger vessel at at least two points along the substantially vertical portion of the frame by means of suitable brackets or the like.

A vessel or raft support arm is pivotally mounted to the frame at or near the outermost end of the substantially horizontal portion of the inverted L-shaped frame. The vessel support arm extends away from the frame but lies within the same vertical plane as the frame.

In one exemplary embodiment, the vessel support arm comprises a pair of relatively rigid tubular members arranged in laterally spaced and substantially parallel relationship, and connected at either end thereof by a respective end cap.

The pivot connection between the support arm and frame is located intermediate the ends of the support arm, but not centrally thereof, so that the arm is effectively divided into major and minor length portions. The major portion of the support arm to one side of the pivot connection is substantially straight, while the minor portion of the support arm to the other side of the pivot is preferably curved throughout.

Other suitable structural configurations for the vessel support arm may also be employed. For example, the support arm may be formed from a single length of tubular material, bent into a substantially U-shape, wherein the base of the U comprises the minor, curved portion of the arm.

By reason of the above described pivot connection, the vessel support arm is swingable through approximately 180° between first and second positions. In the first position, the major portion of the vessel support arm extends away from the frame, and the minor portion engages the underside of the reinforcing frame member. The outer end of the support arm is thus adapted to support a vessel, such as an inflatable life raft, in a horizontal or deployment position by intermediate means such as a block and tackle, pulley, or the like.

In a second position, the vessel may be supported substantially vertically on its side. To do so, the vessel must be removed from the davit (if not already removed). Thereafter, the vessel support arm is swung counterclockwise approximately 180° to a retracted position where the minor portion of the support arm extends away from the frame, and the major portion rests on an upperside of the horizontal portion of the frame.

In one exemplary embodiment of the invention, the curved surface of the minor portion of the vessel corresponds generally to the curvature of the side wall of an inflatable life raft so that the latter may be supported directly on the support arm. A locking pin may be provided to insure that the support arm will not rotate away from this position, due to the weight of the vessel.

Thus, the present invention provides a lightweight and simple davit construction having a vessel support arm which can be moved by hand to one or the other of two vessel supporting positions.

Additional objects and advantages of the present invention will become apparent from the detailed description which follows.

BRIEF DESCRIPTION OF THE DRAWINGS

FIG. 1 is a perspective view of a davit assembly in accordance with one exemplary embodiment of the invention, with the vessel supporting arm in an extended position;

FIG. 2 is a perspective view of the davit assembly illustrated in FIG. 1, but with the vessel supporting arm in a retracted position;

DETAILED DESCRIPTION OF THE DRAWINGS

Figure 6:
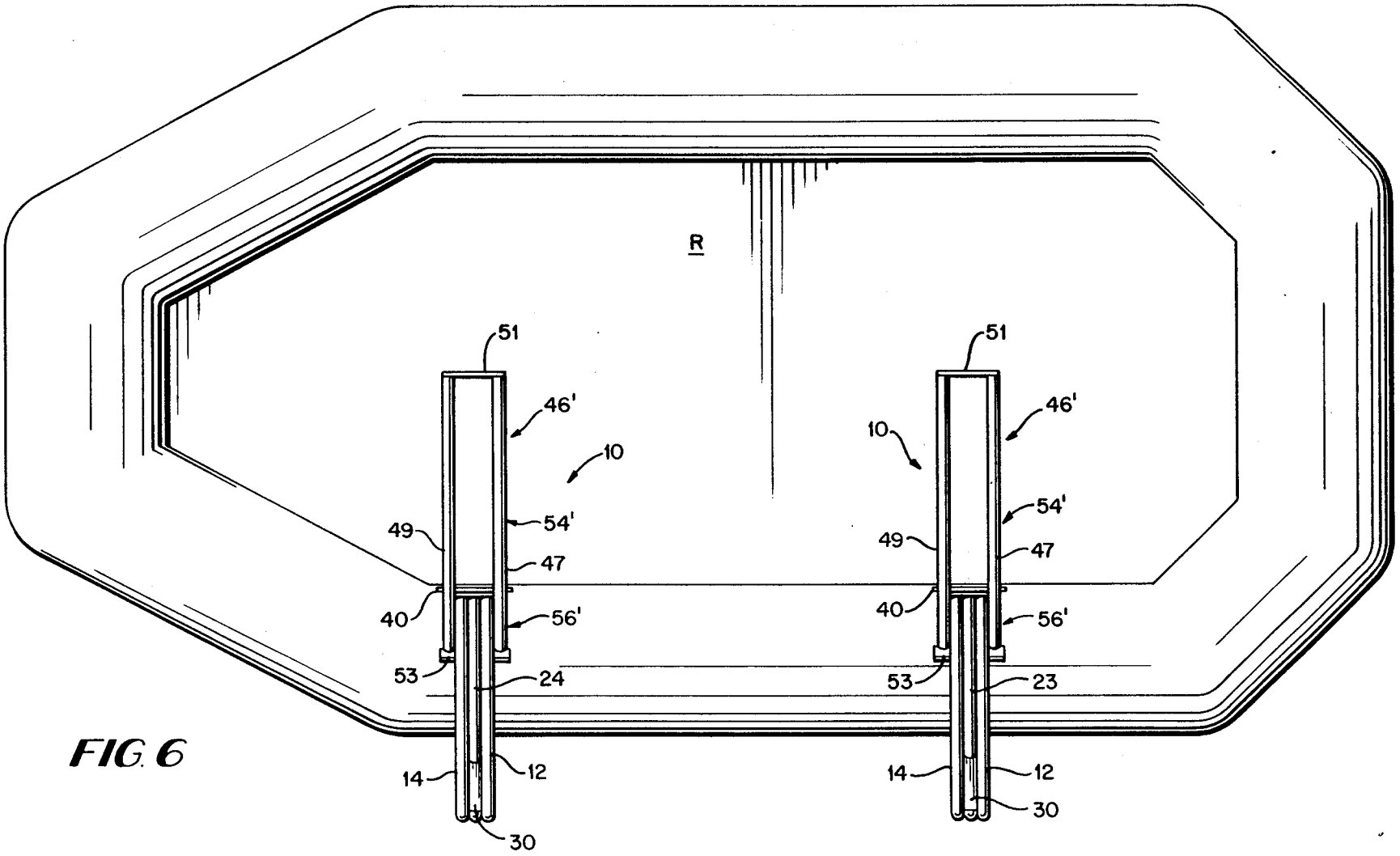
FIG. 6 is a top view of the preferred davit assembly as shown in FIG. 5A but with a raft supported therefrom in a first position.
Figure 7:
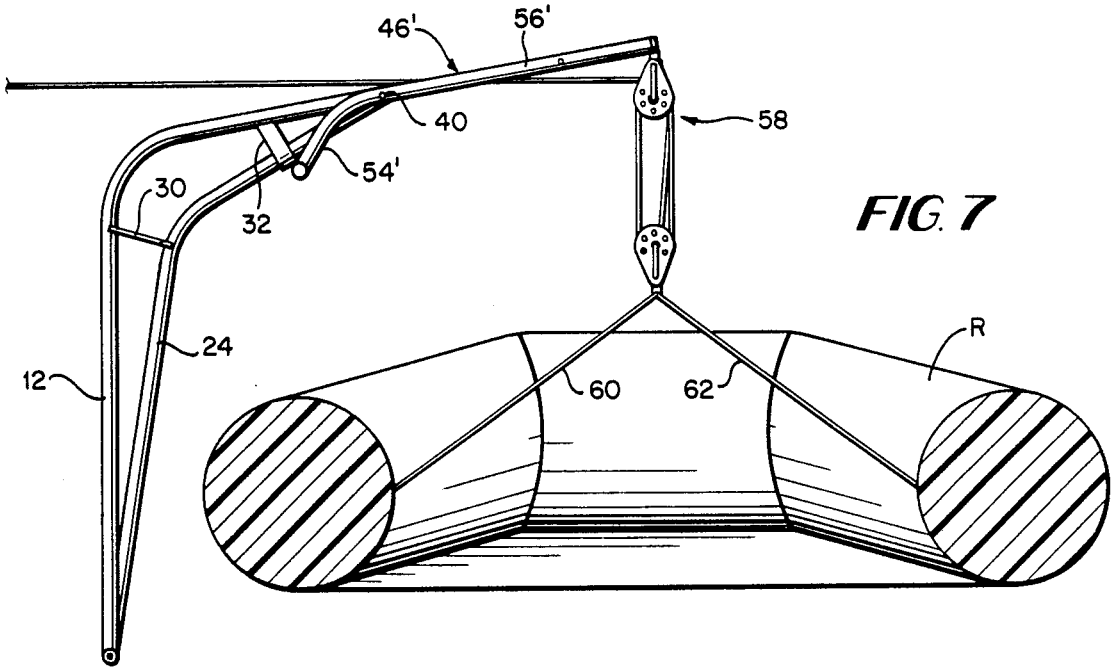
FIG. 7 is a a partial side view of the davit assembly shown in FIG. 6.
Figure 8:
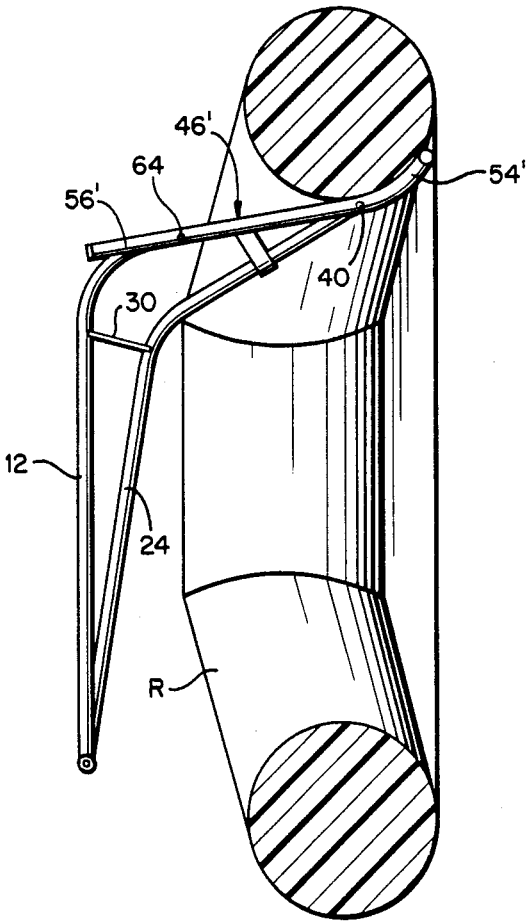
FIG. 8 is an enlarged view of the davit assembly shown in FIG. 5E but with a raft supported thereon in a second position.

With reference now to the drawings, and particularly to FIG. 6, it will be appreciated that two identical davit assemblies 10 are required to support a vessel, such as a small boat, dinghy or inflatable raft. Since both are identical, only one need be described in detail. Referring back now to FIGS. 1 and 2, each davit assembly 10 includes a frame comprising a pair of parallel, tubular main frame members 12, 14 joined at each end thereof in a manner to be described herein. The one frame member 12 is bent to provide a substantially vertical portion 16 and a substantially horizontal portion 18. Similarly, the parallel frame member 14 is bent to provide a substantially vertical portion 20 and a substantially horizontal portion 22. Thus, it may be appreciated that members 12 and 14 are substantially identical, and form a generally inverted L-frame structure.

Between the laterally spaced frame members 12 and 14 there is located a reinforcing frame member 24 which extends from the lowermost end of members 12 and 14, to the uppermost end of the same members. Member 24 is provided with upper and lower portions 26, 28 which are inclined relative to portions 16, 20 and 18, 22, respectively, of the main frame members. In other words, member 24 is generally similar to frame members 12 and 14 but is less sharply angled, and is sandwiched between the main frame members at their respective ends. A reinforcing plate or gusset 30, and a support bracket 32 are provided intermediate the ends of the members 12, 14 and 24 to further strengthen and rigidify the main connection therebetween as described below.

At the lowermost end of the davit assembly, members 12, 14 and 24 may be secured together by a first tubular end cap 34, while a similar connection may be made at the upper end via a second tubular end cap 36.

An aperture 38 is provided in the lower end cap 34 of the assembly for receiving a pin (not shown) for easy attachment of the davit to a suitable support on the larger vessel. A further connection between the davit and, for example, a horizontal railing on the larger vessel, may be achieved by suitable bracket means (not shown) mounted along the substantially vertical portion of the frame members 12, 14.

A vessel support arm 46 is pivotally mounted to the second end cap 36 by means of a pin 40 which extends through the end cap and through aligned apertures provided in frame members 12 and 14.

In one exemplary embodiment (FIGS. 1 and 2), the vessel support arm comprises a single tubular member 46 bent to form a generally U-shaped support, joined at their free ends 48, 50 by a cross brace 52.

In a preferred arrangement (FIGS. 3 and 4), the vessel support arm 46 comprises two individual tubular members 47, 49 held in a laterally spaced, and substantially parallel arrangement by a pair of cross pieces 51, 5.3, welded or otherwise suitably secured in place. Cross piece 51 may comprise a flat plate, while cross piece 53 may comprise a tubular member of similar stock as members 47, 49. As in the first described embodiment, the vessel support arm 46 is pivotally mounted to the frame members at a location intermediate&e the ends thereof.

It will be understood that the pivot mounting location for the vessel support arm 46 or 46' to the frame members 12, 14 is closer to one end of the support arm than the other. The longer extension, or major portion 54 or 54' of the arm is relatively straight, while shorter extension, or minor portion 56, or 56' of the arm is curved or inclined relative to a plane passing through the straight portion of the arm. The curvature in the minor portion of the arm is designed generally to conform with the curvature of a sidewall of an inflatable life raft for a purpose to be explained hereinbelow.

The pivotal connection between the arm 46 or 46' and frame members 12, 14 via pin 40, enables the vessel support arm to be swung back and forth between alternative vessel supporting positions as explained in more detail below.

Figure 4:
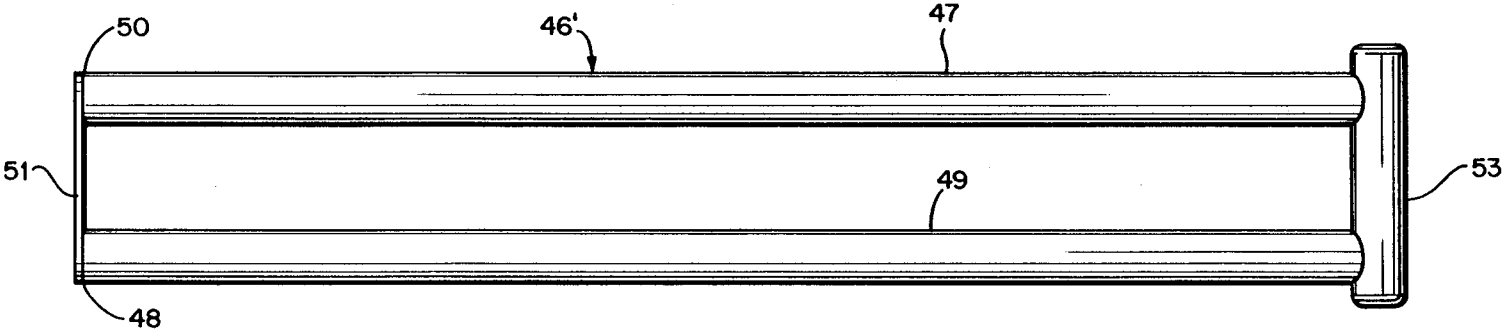
FIG. 4 is a top view of the vessel support arm illustrated in FIG. 3.
Figure 3:
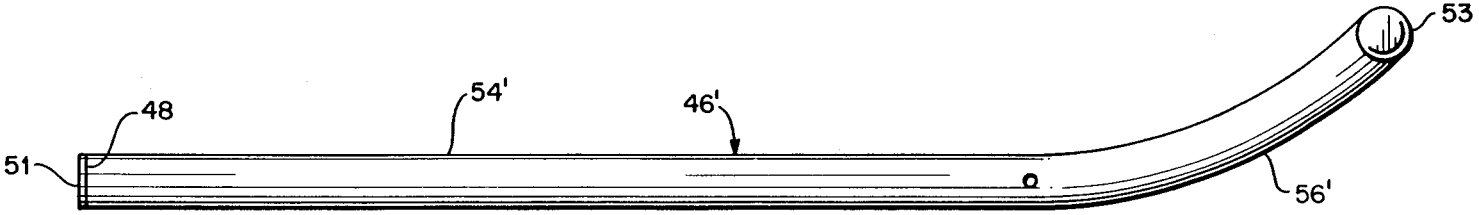
FIG. 3 is a side view of a preferred embodiment of a vessel support arm for use with the davit assembly according to this invention.
Figure 5A:
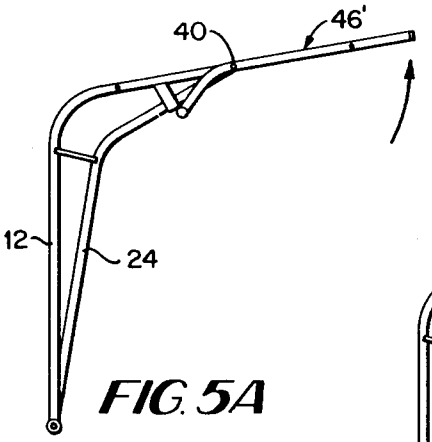
FIGS. 5A through 5E are side views of the davit assembly in accordance with a preferred embodiment of this invention and illustrating the movement of the vessel support arm from a first extended position to a second retracted position.
Figure 5B:
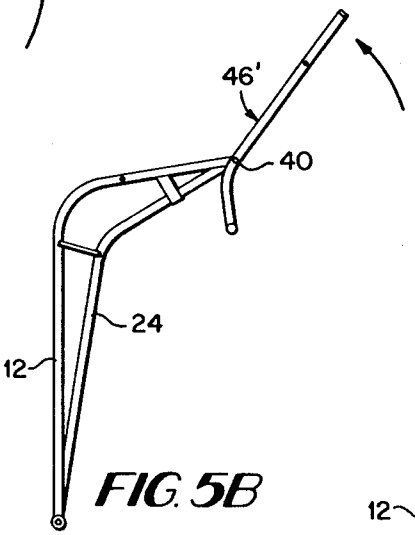
Figure 5C:
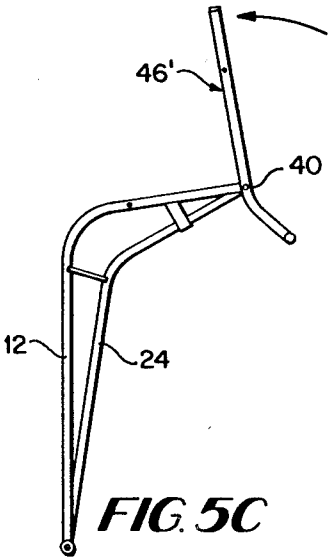
Figure 5D:
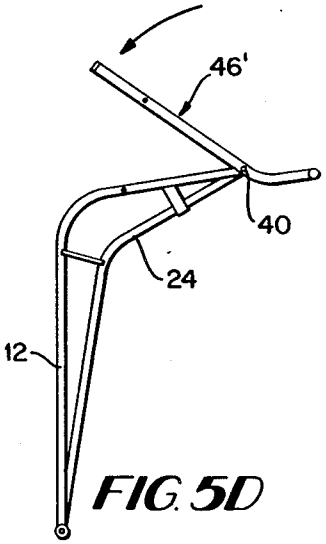

With reference to FIG. 5A, for example, it may be seen that the support arm 46' is in a first position adapted to support a raft R in a horizontal or deployment position as also shown in FIGS. 3 and 4, i.e., with the bottom of the raft substantially parallel to the water surface. In this configuration, the major, straight portion 54' of the arm extends away from the frame members 12, 14 in substantially the same plane as the upper frame portions 18, 22. At the same time, the end cap 53 of the minor curved portion 56' of the arm abuts an underside surface of the upper portion 26 of reinforcing member 24, adjacent the plate or gusset 32. In this way, a downward force exerted by the weight of a raft at the outer free end of arm 46' creates an upwardly directed reaction force on the frame via reinforcing member 24.

With specific reference to FIG. 3, it may be appreciated that a block and tackle assembly 58 and associated ropes or cables 60, 62 may be utilized to suspend the raft or other vessel from the outermost free end of the vessel support arm 46'. The block and tackle assembly has been omitted from FIG. 4 merely for purposes of clarity. In any event, FIG. 4 further illustrates the location of a pair of davit assemblies 10 position to fully support the raft R in a horizontal position.

Figure 5E:
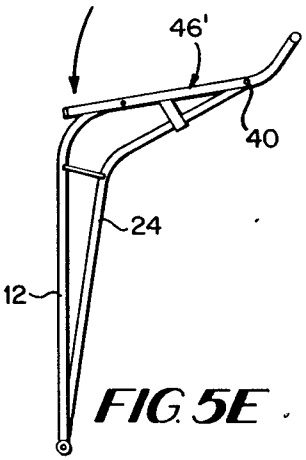

If it is desired to support the raft R in a more compact and space-saving manner, the arm 46' may be rotated counterclockwise through approximately 180°, as shown in FIGS. 5A through 5E, to a second position illustrated in FIG. 5E. Here, the major, straight portion of the arm remains substantially within the plane of the upper frame portions 18, 22 but extend in the opposite direction relative to the first position. In addition, the minor curved portion 56' now curves upwardly away from the major or straight portion 54', providing a curved support surface for a substantially corresponding curved surface of the raft, as best seen in FIG. 6. This arrangement also prevents the raft from sliding off the davit to the water side.

The tendency toward clockwise motion of the arm do to the weight of the raft, is prevented by the use of a pin 64 insertable through apertures 65 provided in frame members 12 and 14 as well as the legs of the support arm 46' which are in axial alignment when the vessel support arm is in the position illustrated in FIGS. 5E and 6. The pin may be provided with a pull ring 66 for ease of insertion and withdrawal.

The davit assemblies in accordance with this invention are constructed preferablY of tubular stainless steel, but it will be understood that other suitably strong, and non-corrosive material may also be used.

It will thus be appreciated that the present invention provides a simple and easy to use, lightweight davit construction which permits desirable flexibility in permitting an inflatable raft, for example, to be supported in alternative positions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A davit assembly for use in supporting a vessel in either of two alternative positions, comprising a relatively stationary and generally upright frame and a vessel support arm pivotally attached to an upper end of said frame for substantially 180° pivotal movement between a first substantially horizontal upright position where a first end portion of said arm is adapted to support a vessel in a substantially horizontal use orientation, and a second substantially horizontal position where a second end portion of said arm is adapted to directly engage and support the vessel in a substantially vertical storage orientation wherein said vessel is turned substantially on its side.

2. The davit assembly according to claim 1 wherein said frame comprises a first generally vertical portion and a second generally horizontal portion extending away from said first generally vertical portion, said vessel support arm being pivotally connected at a remote end of said horizontal portion.

3. The davit assembly according to claim 1 wherein said vessel support arm is pivotallY attached to the frame at a non-central location intermediate opposite ends of the vessel support arm.

4. The davit assembly according to claim 1 wherein said second portion of said arm is inclined relative to said first portion of said arm.

5. The davit assembly according to claim 4 wherein said vessel support arm is pivotally attached to said frame in a transition area between the first and second portions of said arm.

6. The davit assembly according to claim 1 and wherein the davit assembly includes a pair of frames and associated vessel support arms for supporting a vessel at spaced locations along the vessel.

7. A davit assembly for supporting a smaller vessel on a larger vessel in at least a pair of alternative positions including a first position where the vessel is supported horizontally such that a bottom surface of the smaller vessel extends substantially parallel to a deck of the larger vessel, and a second position where the smaller vessel is supported vertically such that the bottom surface of the vessel extends substantially perpendicular to the deck of the larger vessel, the davit assembly comprising at least one upright, generally inverted L-shaped frame member including a substantially vertical portion and a substantially horizontal portion, and a vessel support arm, said vessel support arm mounted to said an outer end of said substantially horizontal portion by a pivotal connection, said support arm swingable between said first position wherein a major portion of said support arm extends outwardly beyond said pivotal connection, and said second position wherein a minor portion of said support arm extends outwardly beyond said pivot connection.

8. A davit assembly according to claim 7 wherein said support arm in said second position is inverted relative to said first position.

9. A davit assembly according to claim 7 wherein said support arm is provided with a curved surface through at least a part of said minor portion.

10. A davit assembly according to claim 9 wherein the smaller vessel comprises an inflatable raft and said curved surface conforms substantially to a portion of the raft.

11. A davit assembly according to claim 7 wherein said frame and said vessel support arm are constructed of tubular steel.

12. A davit assembly according to claim 7 wherein said frame is provided with at least one reinforcing member.

13. A davit assembly according to claim 7 and further comprising block and tackle means for supporting said smaller vessel from said support arm in said first position.

14. A davit assembly according to claim 7 wherein when said support arm is in said first position, the minor portion thereof engages an underside portion of said frame so that when a downward force is exerted on the major portion of the support arm, a corresponding reaction force is exerted upwardly on said frame.

15. A davit assembly according to claim 14 wherein when said support arm is in said second position, the major portion of said support arm engages an upper side portion of said frame, and said smaller vessel is adapted to be supported substantially directly above said pivotal connection.

16. A davit assembly for supporting a vessel having a pair of sides and a bottom comprising:

first means for supporting the vessel in a first suspended position wherein said vessel is oriented substantially upright with the bottom in a substantially horizontally plane;

second means for directly engaging one of said sides of the vessel so as to support the vessel in a second position wherein said vessel is turned sideways substantially 90° relative to said first position so that said pair of sides lie in a substantially vertical plane and said bottom extends substantially parallel to said vertical plane; and wherein said first and second means comprise first and second opposite end portions of a single vessel support arm pivotally mounted intermediate said opposite end portions to a substantially stationary frame for swinging movement, through about 180° to support said vessel in said first and second positions.

17. A davit assembly according to claim 16 wherein said first portion comprises a relatively straight length of said vessel support arm, and wherein said second portion comprises a relatively curved length of said vessel support arm.

18. A davit assembly according to claim 17 wherein said first means also comprises a block and tackle suspended from a distal end of the relatively straight portion of the vessel support arm.

19. A davit assembly according to claim 16 wherein said vessel support arm comprises a pair of laterally spaced, substantially parallel members connected at forward and rearward ends thereof.

20. A davit assembly according to claim 19 wherein said first portion comprises a relatively straight length of said vessel support arm, and wherein said second portion comprises a relatively curved length of said vessel support arm.

21. A davit assembly according to claim 16 wherein said vessel support arm comprises a single tubular member formed in a substantially U-shape.

22. A davit assembly for supporting a smaller vessel on a larger vessel in at least a pair of alternative positions including a first position where the vessel is supported horizontally such that a bottom surface of the smaller vessel extends substantially parallel to a deck of the larger vessel, and a second position where the smaller vessel is supported vertically such that the bottom surface of the vessel extends substantially perpendicular to the deck of the larger vessel, the davit assembly comprising at least one upright frame and a vessel support arm, said vessel support arm mounted to said frame by a pivotal connection, said support arm swingable between said first position wherein a major portion of said support arm extends away from the frame, and said second position wherein a minor portion of said support arm extends away from said frame, wherein said support arm is provided with a curved surface through at least a part of said minor portion, and wherein the smaller vessel comprises an inflatable raft and said curved surface conforms substantially to a portion of the raft.

23. A davit assembly for supporting a smaller vessel on a larger vessel in at least a pair of alternative positions including a first position where the vessel is supported horizontally such that a bottom surface of the smaller vessel extends substantially parallel to a deck of the larger vessel, and a second position where the smaller vessel is supported vertically such that the bottom surface of the vessel extends substantially perpendicular to the deck of the larger vessel, the davit assembly comprising at least one upright frame and a vessel support arm, said vessel support arm mounted to said frame by a pivotal connection, said support arm swingable between said first position wherein a major portion of said support arm extends away from the frame, and said second position wherein a minor portion of said support arm extends away from said frame, wherein when said support arm is in said first position, the minor portion thereof engages an underside portion of said frame so that when a downward force is exerted on the major portion of the support arm, a corresponding reaction force is exerted upwardly on said frame.

24. A davit assembly according to claim 23 wherein when said support arm is in said second position, the major portion of said support arm engages an upper side portion of said frame, and said smaller vessel is adapted to be supported substantially directly above said pivotal connection.

* * * * *